United States Patent [19]

Ballestrazzi et al.

[11] Patent Number: 4,709,530

[45] Date of Patent: Dec. 1, 1987

[54] CENTRALIZED DRIVE DEVICE IN A PACKAGING MACHINE

[75] Inventors: Aris Ballestrazzi; Lamberto Tassi, both of, Savignano Sul Panaro, Italy

[73] Assignee: Sitma Societa Italiana Macchine Automatiche S.p.A., Spilamberto, Italy

[21] Appl. No.: 883,150

[22] Filed: Jul. 8, 1986

[30] Foreign Application Priority Data

Jul. 17, 1985 [IT] Italy ..... 22526/85[U]

[51] Int. Cl.[4] ..... B65B 11/12

[52] U.S. Cl. ..... 53/209; 53/167; 474/31

[58] Field of Search ..... 53/167, 209, 548, 559; 474/31, 30, 29, 164

[56] References Cited

U.S. PATENT DOCUMENTS 3,242,636 3/1966 Evanson et al. ..... 53/167 X
3,916,705 11/1975 Smith et al. ..... 474/31
3,942,299 3/1976 Bory ..... 53/167 X
4,060,959 12/1977 Fiedler et al. ..... 53/209 X

*Primary Examiner*—James F. Coan
*Attorney, Agent, or Firm*—Fleit, Jacobson, Cohn & Price

[57] ABSTRACT

A centralized drive device in a machine for packaging products in continuous plastic film which unwinds from a reel comprising essentially a feed unit for said products, an individual product feed unit, a unit for wrapping said products in said film, and a unit for welding and cutting the individual packaged products, in which a rigid transmission shaft extends along the entire length of the interior of the packaging machine from a central variable-speed drive. A series of individual motion transmissions, each operating one of the units of the machine, branches from the shaft, there being also connected to the variable-speed drive a further variable-speed drive which, by positive transmission, drives a belt for conveying the products to be packaged, in accordance with the predetermined succession.

4 Claims, 2 Drawing Figures

CENTRALIZED DRIVE DEVICE IN A PACKAGING MACHINE

This invention relates to a centralised drive device in a packaging machine.

Known packaging machines are usually provided with a main drive from which various conventional chain or belt transmissions extend, these being often disposed in series to drive the various machine components.

As packaging machines comprise a large series of components and parts which during operation are to be driven in phase with each other and at different speeds according to requirements, these chain and/or belt transmissions and branches deriving from the main drive lead unfortunately to slackness and phase differences, which sometimes multiply along the line.

In addition, packaging machines use continuous plastic film webs for receiving the products to be wrapped and packaged. Generally the film is unwound from a reel and is suitably guided to receive the package products which are then at least partially wrapped in it. The film is then welded and cut transversely to the film feed direction between one product and the next so as to create individual packages.

The plastic material is usually fed and/or dragged by means which are also driven by the central drive by way of transmissions of the aforesaid type, and by virtue of its own nature undergoes slippage relative to the products to be packaged, leading to consequent displacement.

In machines in which the plastic film is of heat-shrinkable type in order to obtain improved packaging and material saving, the interspaces between the products must be limited while at the same time maintaining correct positioning with respect to the plastic film which wraps them, and which in some cases is printed or provided with reference signs which require precise determined positioning to be respected.

These various problems are difficult to solve and the various requirements difficult to satisfy precisely because of the slackness or slippage deriving from the series transmissions and the type of material.

In particular, even if the individual errors which arise are minimal, it is natural that when several transmissions are disposed in series the errors increase and become intolerable for the purposes of correct operation and packaging.

An object of the present invention is to nullify or at least minimise the errors or possible slippages caused by the transmissions driving the numerous components which have to be phased and moved in precise succession.

A further object is to enable all the component parts to remain in their proper phase setting as the operating speed varies, thus always resulting in perfect packaging.

These and further objects are attained according to the present invention by a centralised drive device in a machine for packaging products in continuous plastic film which unwinds from a reel, said packaging machine comprising essentially a feeder unit for said products, an individual product feed unit, a unit for wrapping said products in said film, and a unit for welding and cutting the individual packaged products, characterised in that a rigid transmission shaft extends along the entire length of the interior of said packaging machine from a central variable-speed drive, from said shaft there branching a series of individual motion trasmissions each operating one of said units of said machine, there being also connected to said variable-speed drive a further variable-speed drive which, by positive transmission, drives a belt for conveying said products to be packaged, in accordance with the predetermined succession.

The operational and structural characteristics and advantages of the device according to the invention will be more apparent from the description given hereinafter by way of non-limiting example with reference to the diagrammatic drawings in which.

Figure 1:
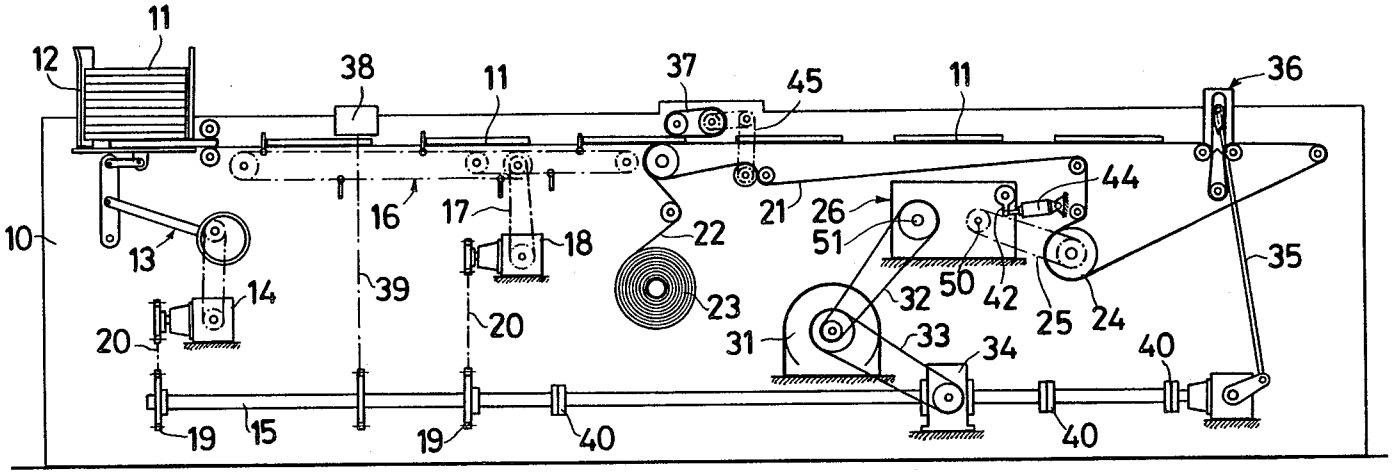
FIG. 1 is a diagrammatic side view of the device.

In the drawings, the reference numeral 10 indicates a side wall of a packaging machine frame.

A series of products 11 are disposed in stacked arrangement in a feeder unit 12 and are fed by a linkage 13, driven by a central transmission shaft 15 by way of a reduction gear 14, to a peg thrust conveyor 16 forming part of an individual product feed unit.

The peg conveyor 16 is driven by a relative transmission 17 also deriving from the central transmission shaft 15 by way of a reduction gear 18.

Both the reduction gear 14 and the reduction gear 18 are driven from sprocket wheels 19 keyed on to the transmission shaft 15, to which they are operationally connected by respective chains 20. The individual product feed unti 11 comprises in addition to the peg conveyor 16 a conveyor belt indicated overall by 21 and disposed subsequent to said peg conveyor 16, to receive the products 11 on a continuous plastic film 22 originating from at least one reel 23, which can be either rigid with the machine or independent of it.

The conveyor belt 21 is driven by a drive roller 24 operated by a transmission chain 25 driven by relative sprocket wheels from a first shaft 50 of a variable-speed drive 26.

The variable-speed drive 26 is of the positive transmission type, and comprises two pairs of mutually facing conical discs 27 or pulleys (see FIG. 2) disposed on the first shaft 50 and on a second shaft 51, and provided with a series of recesses 28 in said facing surfaces. A multiple transmission chain 29 with lateral blade-type links 30 mobile transversely to said chain provides precise motion transmission under varying speed conditions, ie as the discs 27 withdraw from or approach each other while said blades remain engaged with the recesses 28. Said second shaft 51 is the input shaft to the variable-speed drive 26 and is driven by a central main variable-speed drive 31 by way of a toothed belt transmission 32. Simultaneously, a second toothed-belt output transmission 33 acts on a main reduction gear 34 which drives the central transmission shaft 15, disposed along the entire length of the packaging machine. The terminal portion of the central transmission shaft 15 operates a linkage 35 which alternately controls a welding and cutting unit 36 for the packaged products 11.

Previously, a second small belt 37 disposed above the first belt 21, and from which it is driven by a branch connection 45 had exactly positioned the products 11 on the unwinding film 22 in such a manner as to respect any printed zones or reference signs present on it.

Folding and conveying elements (not shown) had immediately afterwards folded the free longitudinal edges of the film 22 around the product 11 before the operation of the welding and cutting unit 36. Advantageously, at least one insert feeder driven by the central transmission shaft 15 and indicated diagrammatically by 38 can be provided before said conveyor belt 21, its operation being in the correct phase with respect to the other operating units for positioning for example labels or inserts by virtue of being driven directly from the central shaft 15 by way of a transmission 39.

As a one-piece central transmission shaft 15 could be somewhat lengthy for its purpose of driving all the units present in the packaging machine, couplings 40 can be provided in order to maintain the rigidity of the single central transmission, while at the same time facilitating its disassembly and relative maintenance.

Figure 2:
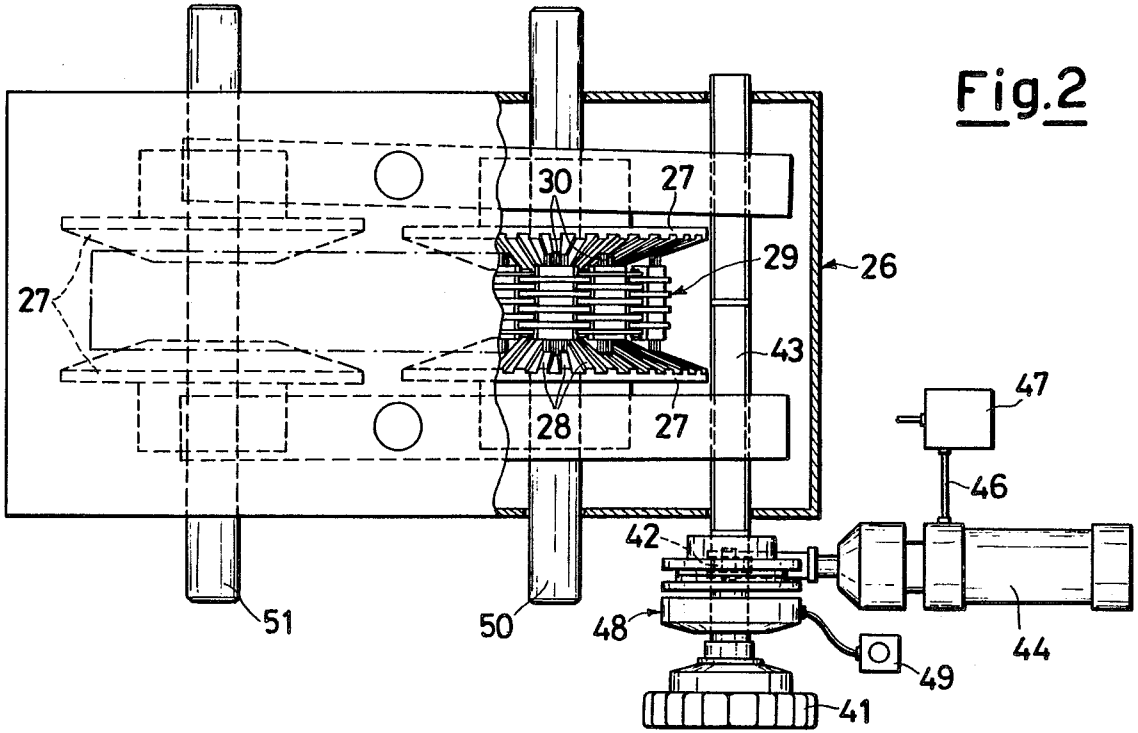
FIG. 2 is a view of a detail of the transmission device shown in FIG. 1.

With reference to FIG. 2, although the variable-speed drive 26 used for varying the packaging pitch of the products 11 is constructed to provide high-precision positive transmission, it can undergo slight pitch deficiencies due to slippage of the main variable-speed drive 31 as the packaging speed varies.

To obviate the drawbacks deriving from these pitch deficiencies, according to the invention the variable-speed drive 26 comprises an adjustment unit incorporating a handwheel 41 acting on a shaft 43 which enables the distance between the pairs of discs 27 to be varies. The handwheel 41, operationally secured to the shaft 43 by a manually releasable connection element 48, such as an electromagnetic coupling, is mechanically operated by a lever 42 pivoted at one end to the rod of an adjustable-stroke cylinder 44, said cylinder 44 being operated directly when a predetermined packaging speed is exceeded, as sensed by a sensor (not shown) which operates a relative solenoid valve 47 connected by a line 46 to the cylinder 44, so as to automatically make packaging pitch corrections of a value of 1–2 mm.

A pushbutton 49 is also provided, which operates the coupling 48 in order to release it and allow the handwheel 41 to be manually operated so as to vary the setting of the variable-speed drive 26 at will when the type of product 11 to be packaged is changed. Besides preventing any possible phase difference between the packaging machine units, a drive device according to the present invention also allows the spaces between the fed products to be reduced, with consequent saving in the packaging material. In particular, it is possible to form packages without the need for subsequent heat-shrinkage. In this respect, whether the film is blank or printed, and whether it is to be subsequently heat-shrunk or not, its adherence to the product is such as to improve the aesthetic effect of the package once sealed.

We claim:

1. A machine for packaging products in continuous plastic film unwound from a reel, the machine comprising a conveying belt for conveying the products, and a sequence of product treatment units associated with the belt including a feeder unit for the products, an individual product advancing unit for receiving products from the feeder unit and delivering same to a receiving end of the conveying belt, a unit for wrapping said products in said film on the conveying belt, and a unit for welding and cutting the individual packaged products adjacent a delivery end of the conveying belt, a rigid transmission shaft extending along the length of the conveying belt from said feeder unit to said welding and cutting unit, a central variable-speed drive for the shaft, a series of individual motion transmissions driven from the shaft each for operating one of said units of the machine, and a further variable-speed drive with a positive transmission connected with the central variable-speed drive for driving the conveying belt.

2. A machine as claimed in claim 1 wherein the further variable-speed drive comprises two pairs of conical discs, the discs of each pair facing each other and being provided on the facing surfaces with a series of inner recesses which interact with a transmission chain comprising blade-type links which are movable transversely to said chain.

3. A machine as claimed in claim 1 wherein the further variable-speed drive is provided with an external adjustment unit for variation of the packaging speed.

4. A machine as claimed in claim 3 wherein the external adjustment unit comprises a cylinder for controlling a setting handwheel which extends from said further variable-speed drive.

* * * * *